United States Patent [19]

Hotchkiss et al.

[11] Patent Number: 4,587,154

[45] Date of Patent: May 6, 1986

[54] OIL AND GREASE ABSORBENT RINSABLE NONWOVEN FABRIC

[75] Inventors: Harry W. Hotchkiss, Marietta; Robert D. Fields, Atlanta; Gina K. Rolsten, Duluth, all of Ga.

[73] Assignee: Kimberly-Clark Corporation, Neenah, Wis.

[21] Appl. No.: 752,986

[22] Filed: Jul. 8, 1985

[51] Int. Cl.[4] ..... B32B 3/00

[52] U.S. Cl. ..... 428/195; 15/209 R; 428/171; 428/284; 428/286; 428/290; 428/297; 428/298; 428/903; 428/913

[58] Field of Search ..... 428/195, 198, 171, 288, 428/290, 903, 913, 284, 286, 297, 298; 15/104.93, 209 R

[56] References Cited

U.S. PATENT DOCUMENTS

| | | | |
|---|---|---|---|
| 4,008,353 | 2/1977 | Gross et al. | 428/290 |
| 4,100,324 | 7/1978 | Anderson et al. | 428/326 |
| 4,307,143 | 12/1981 | Meitner | 428/156 |
| 4,328,279 | 5/1982 | Meitner et al. | 428/903 |
| 4,426,417 | 1/1984 | Meitner et al. | 428/903 |
| 4,493,868 | 1/1985 | Meitner | 428/903 |

*Primary Examiner*—James J. Bell
*Attorney, Agent, or Firm*—William D. Herrick

[57] ABSTRACT

A nonwoven fabric having oil and grease absorbency properties but also having the capability to release at least about 60 percent of such oil or grease in accordance with the grease release test described. Such webs include a matrix of microfibers and may include up to about 75 percent of other fibers such as staple or wood pulp. The web is treated with one or more compositions selected from carboxymethyl cellulose and derivatives, vinyl carboxypolymers, hydroxy ethyl ether starch derivatives, and acrylics. The treatment permits the web to retain its fibrous structure while at least partially coating said fibers to reduce the oleophilic nature of the web. Examples of useful fibers include polyolefins, especially polypropylene, polyesters, and polyamides. The web is preferably bonded by a patterned application of fuse bonds covering up to about 14 percent of surface area and in a frequency of up to about 15 bonds per square inch. The result is a web particularly useful as a wiper for food service application where it aggressively absorbs and retains oily and greasy materials and yet when rinsed and wrung out releases a high proportion of such oils and greases so that upon reuse streaking is minimized. The preferred embodiment is a matrix including 25 percent polypropylene microfibers and 75 percent of a mixture of polyester and cotton staple bonded with a continuous cross-hatch pattern covering 14 percent of the surface area and 4 lines per inch and treated with up to 2 percent of a crosslinked polycarboxylic resin and polyethylene glycol in the finished fabric.

13 Claims, 6 Drawing Figures

OIL AND GREASE ABSORBENT RINSABLE NONWOVEN FABRIC

BACKGROUND OF THE INVENTION

1. Field of the Invention

The present invention is directed to absorbent nonwoven fabrics useful, for example, for applications such as wipers, protective covers, and the like. In particular, the nonwoven fabrics of the present invention not only demonstrate high absorbency for oils and greases but also have the ability to easily release such materials upon application of moderate pressure as by hand wringing or squeezing. These fabrics will be ideally suited for food service wiper applications as well as for limited use applications such as protective covers for under auto use or to place over auto upholstery during repairs. Nonwoven fabrics of this type are generally made by collecting fibers or filaments into a web and bonding the web before or after treating the fibers or filaments to obtain desired properties. Such fabrics may be used as so formed or may be combined with other fabrics or components in the construction of products for these and various other applications.

2. Description of the Prior Art

It is well-known to form nonwoven webs having a high affinity for oils and greases. Further, it is well-known to form such webs from microfibers for wiper applications. Examples of such wiper products are described in U.S. Pat. No. 4,307,143 to Meitner dated Dec. 22, 1981, U.S. Pat. No. 4,328,279 to Meitner and Englebert dated May 4, 1982, and U.S Pat. No. 4,426,417 to Meitner and Hotchkiss dated Jan. 17, 1984. The last of these patents also describes wiper materials containing microfibers in a mixture with other fiber components including staple synthetic fibers and cotton fibers. While such wipers have been highly useful in absorbing oil and grease for single use applications, many wiper applications require a wiper that can be wrung out and reused over an extended period. In particular, wipers for food service applications such as in restaurants, cafeterias, and the like require that the wiper be capable of being wrung out, rinsed and reused. For these applications conventional microfiber wipers have not been entirely satisfactory since the highly oleophillic nature of the fibers combined with the aggressive structure created by the capillaries tends to hold oil and grease so that it is not easily released upon wringing out or squeezing. In addition, nonwoven fabrics used for protective covers for auto upholstery or under auto use over floors will desirably release oil and grease upon rinsing and wringing out. Similarly oil scavengers for use on oil spills advantageously will release the oil upon squeezing both for purposes of reuse of the scavenger and for recycle of the oil. For these and other applications, it is desired to improve nonwoven fabrics and particularly the ability of such nonwoven fabrics to easily rinse oil and grease.

SUMMARY

The present invention is directed to a nonwoven fabric that is oil and grease absorbent and has good oil rinsing properties and comprises a web of thermoplastic microfibers. The web is treated to contain depending upon the composition, about 0.5 to 7.5 percent by weight of final dry fabric of one or more of the following film-forming compositions: sodium carboxy methylcellulose, polycarboxylic resins crosslinked with a bivalent metal ion, hydroxy ethyl ether starch derivatives, and polyacrylates. The nonwoven web demonstrates oil capillary suction properties comparable to such fabrics without the described treatments. As such, it is highly useful for applications such as food service wipers where it will be used to absorb oil or grease materials, rinsed and wrung out, and reused. In these applications a wiper will release at least about 60 percent of absorbed oil as measured by the rinsibility test described below.

Preferred embodiments include those wherein the microfibers are meltblown polypropylene and wherein the treatment is a polycarboxylic resin crosslinked with a bivalent metal ion, e.g. Carbopol 934 from B. F. Goodrich. For certain applications, it will be preferred to mix up to about 75 percent by weight of other fibers with the microfibers, in which case such other fibers may include, for example, synthetic staple fibers, cotton fibers or pulp fibers or mixtures of any of these.

For applications where a soft web is desired, the treatment composition will preferably include a softening agent such as polyethylene glycol in an amount of up to about 3.5 percent by weight based on the dry weight of the treated fabric. The composition may be applied to the web by various known applications such as coating, impregnating, printing or the like. The result is a nonwoven fabric having highly beneficial properties for use as a wiper, particularly for food service applications, and also as a material for other applications which have been identified above.

DESCRIPTION OF THE PREFERRED EMBODIMENTS

Figure 1:
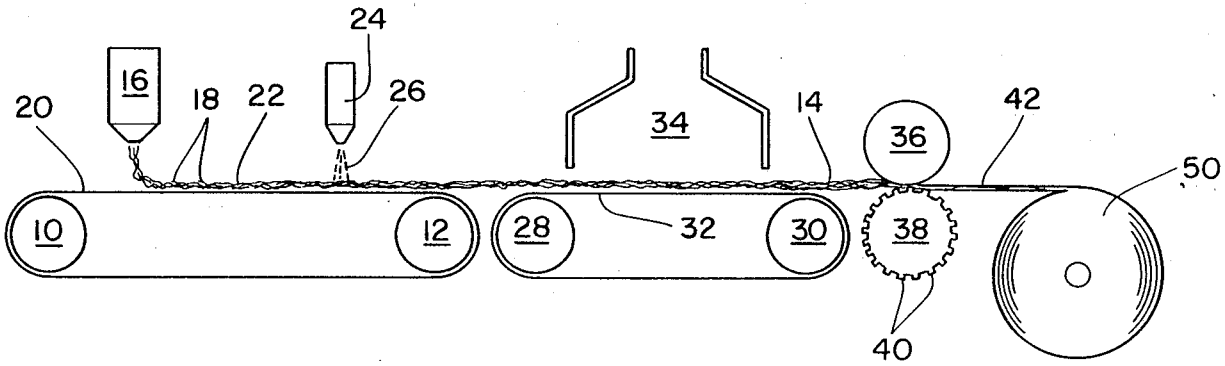
FIG. 1 is a schematic illustration of one process for producing the nonwoven web of the present invention.

The basic structural framework for the absorbent material of the present invention is a web including thermoplastic microfibers. Such fibers will preferably be of a synthetic polymer such as polypropylene, but may be of other compositions as well including, by way of illustration and not limitation, polyesters, polyamides, and even other extrudable materials such as glass. While the oleophillic nature of the polymer contributes to the high absorbency of oils and greases, the network of fine capillaries created by the microfibers is believed to be primarily responsible for such absorbency. Therefore, the chemical composition of the fibers may vary widely. The microfibers will have an average diameter broadly within the range of up to 10 microns and, preferably, within the range of about 2–6 microns. For most applications the web will have a basis weight in the range of about 30 to 250 grams per square meter (gsm) and, preferably, for food wipe applications, in the range from about 50 to 120 gsm. Such webs are known and may be produced in accordance with the meltblowing process described, for example, in U.S. Pat. No. 3,825,380 to Harding, Keller, and Buntin dated July 23, 1974, which is incorporated herein by reference and U.S. Pat. No. 3,978,185 to Buntin, Keller, and Harding dated Aug. 31, 1976 which is also incorporated herein by reference.

While such meltblown microfiber webs may be used for the base nonwoven fabric as thus formed, for many applications even further improvements may be obtained using a web that contains other components such as wood pulp, cotton or synthetic staple fibers or any combination of these integrated within the microfiber web matrix. The use of such additional components permits even greater control of the web properties and internal construction. Examples of such additional components include wood pulp, staple fibers such as cotton, polyester, nylon, rayon, and mixtures of any of these. Formation of microfiber webs containing these additional components is preferably carried out in accordance with U.S. Pat. No. 4,100,324 to Anderson, Sokolowski, and Ostermeier dated July 11, 1978 which is incorporated herein by reference. In accordance with this process, generally, wood pulp or staple fibers are introduced into a separate air stream that is combined with the air stream of a meltblowing process prior to web formation so that the vortices created in the air stream result in an intimate mixture of the fiber components. Webs of these mixtures and their use in wiper applications is disclosed, for example, in U.S. Pat. No. 4,426,417 to Meitner and Hotchkiss dated Jan. 17, 1984. The relative portions of the individual components may vary widely, but to achieve the results of the present invention, a microfiber component must be at least about 20 percent by weight of the finished fabric and is, preferably, between 25 to 50 percent by weight. Within this range, the other components may vary as desired to produce the intended results as will be apparent to those skilled in the art. For example, cost considerations may suggest higher content of the low cost fiber.

After forming the integrated web matrix, either of microfibers alone or of microfibers mixed with other components, the web is bonded to produce the desired degree of integrity required for the intended use. In order to preserve the desired absorbency and tactile characteristics, the web is preferably bonded in a pattern which covers up to about 30 percent of the surface area, preferably up to about 15 percent. While the pattern may vary widely in configuration, if it is a line pattern, it is up to about 15 lines per inch, preferably up to 4 lines per inch ($1\frac{1}{2}$ lines/cm) and if a discontinuous pattern, up to about 200 bonds per square inch, preferably up to 15 bonds per square inch. In this manner, the desired strength properties can be obtained without sacrificing absorbency or tactile properties. This pattern bonding is preferably obtained by means of application of heat and pressure either by passing the web through a nip between one or more patterned rolls or between a sonic horn and patterned anvil. Alternatively, a patterned adhesive application may be used and, if selected, such adhesive is preferably an acrylic latex (Rohm & Haas E-2072). For wiper applications, the resulting web will preferably have a tear strength in the range of about 300 grams/centimeter to 2000 grams/centimeter, a grab tensile in the range of from about 1380 grams/centimeter to 4,000 grams/centimeter, for example.

The so-formed web, whether of microfibers alone or of microfibers mixed with other components, in accordance with the invention, is treated with a composition that permits retention to a high degree of the oil and grease absorbency properties while it results in the web readily releasing such oils and grease upon rinsing and wringing out. While the invention is not to be limited to any particular theory, it is believed that the treatments in accordance with the invention result in a film formation at least partially coating and adhering to the individual fibers while yet retaining the fibrous structure of the web matrix. Examples of such compositions include carboxy methyl cellulose and derivatives such as CMC4H1 available from Hercules, polycarboxylic resins cross-linked with a bivalent metal ion such as Carbopol 934 available from B. F. Goodrich, hydroxy ethyl ether starch derivatives such as Penford Gum 230 available from Pennick and Ford Company, and polyacrylates such as polyacrylamide resins available as Prym 119 from Sun Chemical Company and Polymeric PC from Dow Corporation. For improved softness, each of the treatment compositions may include up to about 40 percent of a softening agent such as polyethylene glycol available as Carbowax 1000 from Union Carbide. The treatment will preferably add up to about 5 percent by weight of the total treatment composition, but the useful range will vary widely depending upon the intended application and may include, for example, up to about 10 percent by weight. Also, the composition may contain up to about 4 percent by weight of a wetting agent such as dioctyl sodium sulfosuccinate available as Aerosol OT 75 from American Cyanamid.

Application of the treatment composition may be by any convenient means for liquids known to those skilled in this art (means for liquids such as spraying, dipping, printing, or the like. If used as a spray, the preferred treatment composition be a solution containing 2 percent of Carbopol 934 the active ingredient. The spray treatment composition may contain up to about 15 percent by weight of active ingredients depending upon the desired concentration on the finished web. When printed, the composition may be more concentrated and include, for example, up to 30 percent by weight of the active ingredients.

Turning to FIG. 1, one process that is anticipated for obtaining the web of the present invention will be described. As shown schematically, forming surface 20 comprising a belt or wire or the like makes an endless loop about support rolls 10, 12, either or both of which may be driven. Meltblowing device 16 which may be as described in U.S. Pat. No. 3,978,185 to Buntin, Keller and Harding dated Aug. 31, 1976, deposits fibers 18 onto the forming surface 20 to form web 22. Spray device 24 applies the treatment composition 26 to the web 22 which is then directed to support surface 32 which moves about an endless loop supported by rolls 28, 30, either or both of which may be driven. Dryer 34 removes excess carrier liquid from the treatment composition, and the dried web 14 is then directed to bonding calender comprising rolls 36 and 38 with the latter having pattern 40 engraved therein. The bonded web 42 may then be directed for further converting or wound into roll 50 for storage.

Figure 2:
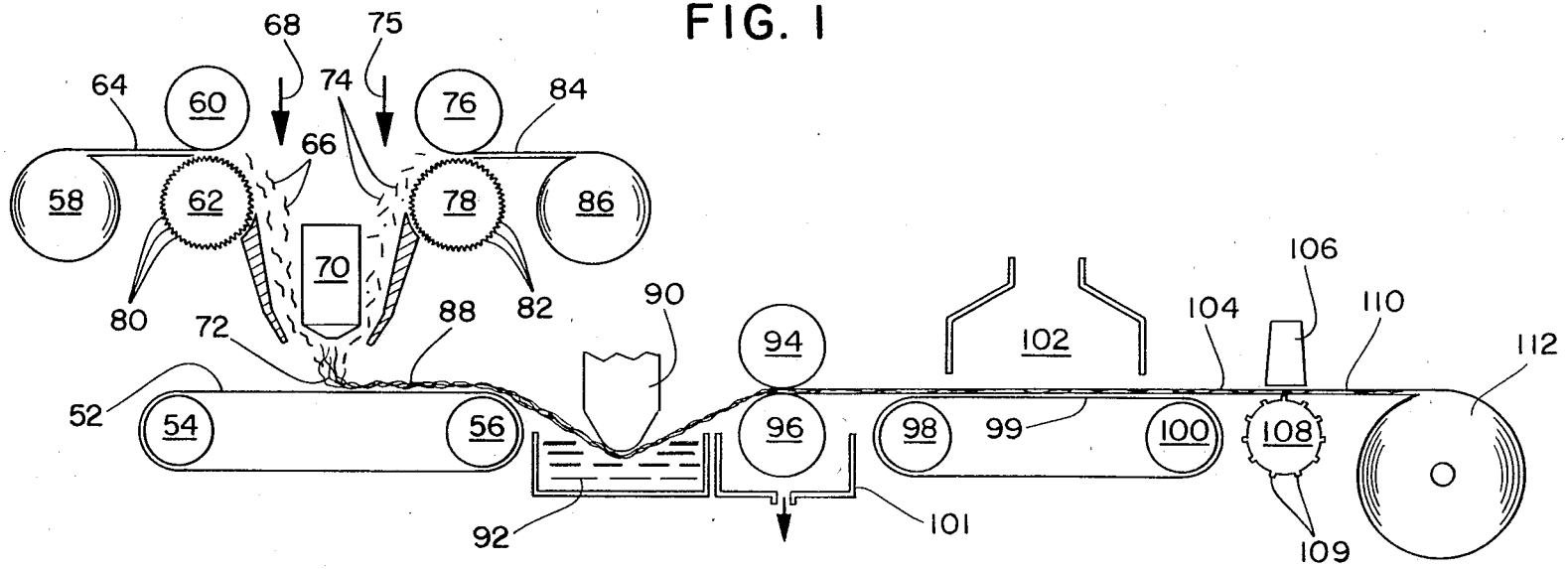
FIG. 2 is a schematic illustration of an alternative process.

Turning to FIG. 2, an alternative method is schematically illustrated. In this case, endless belt or wire 52 provides a forming surface by rotation around rolls 54, 56 either or both of which may be driven. Pulp or staple fiber web 64 is unwound from roll 58 and separated into fibers 66 by means of picker roll 62 having teeth 80 and anvil roll 60. Fibers 66 are directed to air stream 68 and combined with meltblown fibers 72 exiting from extrusion and die apparatus 70. A similar picking arrangement for the same or different fibers comprises supply roll 86 forming web 84 directed to picker roll 78 with teeth 82 and anvil roll 76 and formed into fibers 74 directed into air stream 75 where they are then combined with the other fibers. This combination is formed into web 88 and directed into treatment bath 92 under support 90. The treated web is then supplied to a squeeze nip comprising rolls 94 and 96 where excess liquid is removed to drip pan 101 prior to being supported on wire 99 supported by rolls 98, 100, either or both of which may be driven. Dryer 102 removes remaining liquid and the dried web 104 is then bonded by passing under sonic horn 106 and over mandrel roll 108 having pattern 109 thereon. The thus bonded web 110 can be directed to further processing or converting or wound into roll 112 for storage. In this case, it can be seen that a wide variety of compositions may be obtained by varying the nature of the fibers 66 or 74.

While webs produced from oleophillic compositions such as polyolefins and polypropylene in particular would be expected to be highly absorbent for oils and greases, such known webs made in accordance with conventional practice have tended to aggressively hold onto absorbed oils and greases. Thus, in use after having once absorbed oil or grease, the fabrics in the form of wipers tend to leave streaks upon further wiping application even after being rinsed and wrung out. To measure this property, a test was devised to weigh the amount of standard animal and vegetable oil that would be released under controlled, reproducible conditions. The motor oil test results were obtained using this procedure as well substituting SAE 40 motor oil for the shortening. In this test, a sample was prepared measuring 6 inches×10 inches and folded in half to form a 6 1 inches×5 inches specimen. A 4 inch diameter, 0.75 inch deep petri dish was placed on a balance which was then set to 0. The sample was placed on the dish and its weight recorded to 0.01 gram. Kroger "Cost Cutter" shortening or facsimile, a blend of animal and vegetable grease in solid form, was added in an amount of 50 grams to a small beaker on a rheostat controlled hotplate set on the "warm" setting and maintained until the shortening was melted. Using a Pasteur pipette, the melted shortening was added to the sample suspended on the dish. The amount of shortening added was approximately equal to about ½ the weight of the test sample and covered circle about 2 inches in diameter. The actual weight of addition was recorded. The greased sample was maintained on the petri dish for three minutes after which 10 grams of "Dawn" detergent in 500 milimeters of water was mixed in a one liter beaker at 45°–46° C. and poured as a wash solution into a 12"×7" dish. The folded sample was removed from the balance and placed, grease side down, in the wash solution and allowed to soak for 10 seconds. The folded sample was then lifted by its corner and wrung through an Atlas laboratory wringer, Model LW-761, Type W-1, equipped with 100 PLI weights. The wash and wring steps were repeated two more times and then the sample put through the wringer two additional times without soaking. The sample was then suspended by its free ends with a bulldog clip attached to a drying rack. The samples air-dried at room temperature for a minimum of four hours and then were oven-dried for five minutes in a convection oven at a temperature of 230±5° F. When cooled, the sample weight was recorded and percent grease release recorded as the sum of the fabric weight and the weight of grease added to the fabric less the oven dry weight after the rinse cycles all divided by the weight of the grease added to the fabric.

Figure 3:
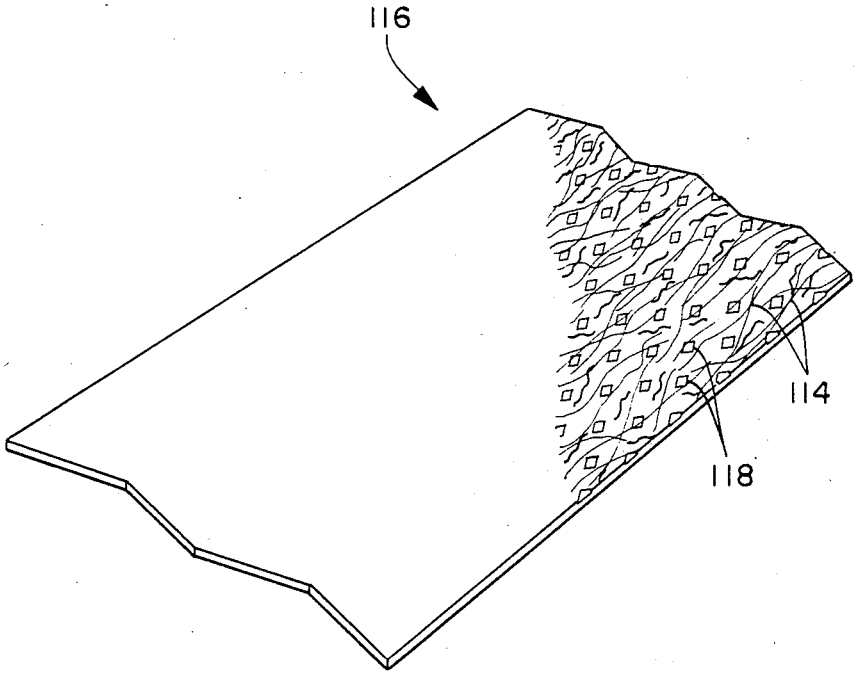
FIG. 3 illustrates one embodiment of the nonwoven web of present invention.
Figure 4:
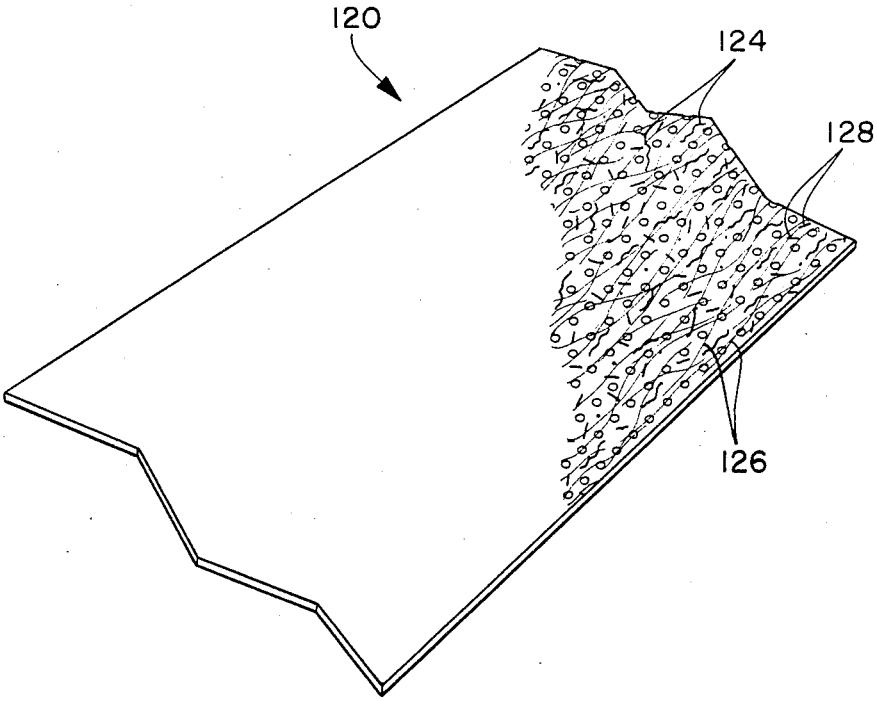
FIG. 4 illustrates an alternative embodiment of a web of the present invention showing a different bond pattern.
Figure 5:
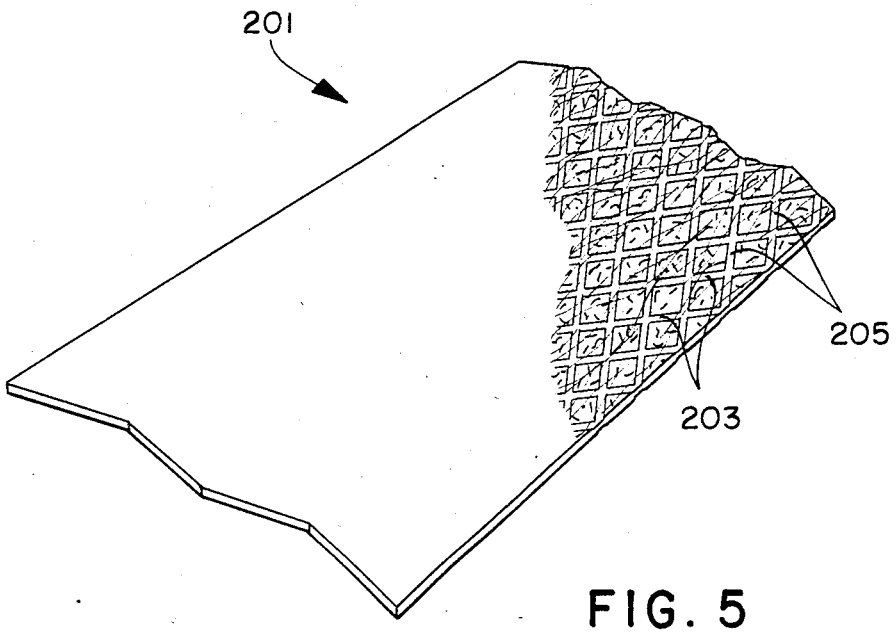
FIG. 5 illustrates a third embodiment showing a line bond pattern.

Turning to FIGS. 3, 4 and 5 there are three examples of nonwoven webs illustrated in accordance with the invention demonstrating representative bond patterns. FIG. 3 shows a meltblown web 116 with microfibers 114 and pattern fuse bond areas 118. FIG. 4 is a similar view of web 120 showing microfibers 126, and mixed therewith staple fibers 124 and wood pulp fibers 128. Bonding in this case was obtained by means of a pattern of sonic bond fuse areas 122. FIG. 5 illustrates fabric 201 having a cross-hatch thermal bond pattern of parallel lines 203 in one direction and parallel lines 205 in an angularly disposed direction.

While the beneficial result of grease release in accordance with the present invention is highly desirable, it is even more significant since it is attained with minimal adverse effect on oil or grease absorption as measured by capillary sorption. This test is described in U.S. Pat. No. 4,307,143 to Meitner dated Dec. 22, 1981 and relates to the pore distribution in the web which affects the ability to wipe cleanly. Specifically, capillary sorption pressure results were obtained essentially as described in Breghini and Cappore, "Capillary Sorption Equilibria and Fiber Masses", TEXTILE RESEARCH JOURNAL, May, 1967, Pages 356 through 366. A filter funnel was movably attached to a calibrated vertical post. The funnel was connected to about 8 inches of capillary glass tubing held in a vertical position. A flat, ground 150 ml Buchner form fritted glass medium Pyrex filter disk having a maximum pore diameter in the range of 10 to 15 microns supported the weighed sample within the funnel. The funnel was filled with Blandol brand white mineral oil having a specific gravity in the range of 0.845 to 0.860 at 60° F. from Whitco Chemical Co., Sonnenborne Division, and the sample was weighed and placed under 0.4 psi pressure on the filter. After one hour during which the meniscus was maintained constant at a given height starting at 35 cm., the sample was removed, weighed, and grams per gram absorbed calculated. The height was adjusted and the process repeated with a new sample until a height of 1 centimeter was reached. The results were plotted as in FIG. 6 with respect to the web structure before treatment (circles) and after (triangles). In general, results obtained below 10 centimeter oil indicate oil contained within large web voids and are not characteristic of a wiper performance. Results obtained at above 15 centimeter oil are most significant as representing oil absorbed within the fibers which will be retained and is an important measure of wiper performance. As may be seen from FIG. 6, treatment in accordance with the invention, in this case in accordance with Example 1A of the Table below, has no significant adverse effect on capillary suction properties.

EXAMPLES

EXAMPLE 1

A meltblown polypropylene web was formed in accordance with the process as generally described in U.S. Pat. No. 3,825,380 to Harding, Keller and Buntin dated July 23, 1974. Thus, polypropylene resin having a melt index of 175 g measured at 177° (Exxon PD 3145) was extruded and contacted at the die tip with converging streams of heated air. The resulting microfibers were collected on a moving foraminous surface at a distance of about 14 inches from the die tip to produce a fabric having a basis weight of about 110 grams per square meter. This fabric was bonded with a woven web pattern as illustrated in U.S. Pat. No. Des. 264,512 to Rogers dated May 15, 1982 having a percent bond area of about 13.6 and average bond points per square inch of about 47 by application of heat (290° F.) and pressure (220 pli) in a bonding tip.

EXAMPLE 2

A polypropylene meltblown web having a basis weight of 82 grams per square meter was formed as in Example 1 except that it was not bonded.

EXAMPLE 3

A web was formed by combining polypropylene meltblown with a combination of polyester and cotton staple fibers in the ratio of 75% of the staple fiber mixture and 25% of the polypropylene by weight and having a total basis weight of 100 grams per square meter and bonded as in Example 1. The staple fiber mixture was nominally 50% cotton and 50% polyester. Such webs and their manufacture are described in further detail in U.S. Pat. No. 4,426,417 to Meitner and Hotchkiss dated Jan. 17, 1984.

EXAMPLE 4

A polypropylene meltblown web was coformed with a mixture of staple fibers (A 1482 available from Leigh Textiles, Inc.) as in Example 1 of U.S. Pat. No. 4,426,417 to Meitner and Hotchkiss dated Jan. 17, 1984 for a total basis weight of 110 grams per square meter. This web was bonded with a cross-hatch pattern as in FIG. 5 having a percent area coverage of 14 and 4 lines per inch. The staple fiber mixture had nominally a percent of 50.

EXAMPLE 5

Example 3 was repeated except that the ratio of the staple fiber mixture to the polypropylene microfibers was reversed to 25/75.

EXAMPLE 6

Example 1 was repeated except that the polymer was nylon and the total basis weight was 88 grams per square meter.

EXAMPLE 7

Example 1 was repeated with polyethylene terephthalate and a total basis weight of 163 grams per square meter.

EXAMPLE 8

A web was formed by coforming wood pulp and polypropylene microfibers as described in U.S. Pat. No. 4,100,324 to Anderson, Sokolowski and Ostermeier dated July 11, 1978, in a ratio of 50/50 for a total of 82 grams per square meter which was embossed with a diamond pattern as in FIG. 4 having a percent area coverage of 14 and 15 bonds per square inch.

TREATMENT AND TEST RESULTS

The webs of Examples 1 through 8 were treated and tested for percent grease rinsability as described above with shortening and motor oil (SAE low 40 grade), and the treatments and test results are shown in the following Table. The treatments were made by immersing the web in liquid treating compositions as indicated in the Table below as A-O, squeezing it in an Atlas Wringer Model No. LW-1 with a 45 lb. wringer arm. Before and after weights yielded percent add-on, and from the concentration, the addition level determined. Treated samples were dried overnight (16 hours) at ambient conditions before testing for grease release.

Treatment solutions were prepared in a mixing vessel equipped with a high speed agitator and heat source to bring to a boil. Deionized water was added first, and Aerosol OT added under agitation and at 90° to 110° F. Treatment chemicals were added gradually and mixing continued to complete solution or dispersion (no lumps).

TABLE

| NOTE: UPPER SQUARE DENOTES PERCENT TREATMENT - LOWER SQUARE INDICATES PERCENT GREASE RELEASED | EXAMPLE 1 | | EXAMPLE 2 | | EXAMPLE 3 | | EXAMPLE 4 | |
|---|---|---|---|---|---|---|---|---|
| | GREASE | OIL | GREASE | OIL | GREASE | OIL | GREASE | OIL |
| A | | | | | | | | |
| CONTROL | | | | | | | | |
| NO TREATMENT | | | | | | | | |
| AEROSOL OT @ .2% | 25.0 | 3.0 | 16.8 | 7.6 | 41.8 | 17.2 | | |
| B | 2.32 | 2.22 | 2.36 | 2.46 | 1.58 | 1.73 | | |
| CARBOPOL 934 @ .75% | | | | | | | | |
| CARBOWAX @ .3% | | | | | | | | |
| AEROSOL OT @ .2% | 53.2 | 40.8 | 49.0 | 31.6 | 85.0 | 80.4 | | |
| C | 0.77 | 0.75 | 0.84 | 0.85 | 0.54 | | | |
| CMC 4H1 @ 25% | | | | | | | | |
| CARBOWAX @ .1% | | | | | | | | |
| AEROSOL OT @ .2% | 57.2 | 37.4 | 44.0 | 15.6 | 67.4 | | | |
| D | 2.97 | 2.99 | 3.25 | 3.24 | 2.15 | | 2.46 | |
| PENFORD 230 @ 1.0% | | | | | | | | |
| CARBOWAX @ .4% | | | | | | | | |
| AEROSOL OT @ .2% | 59.8 | 25.0 | 19.4 | 13.0 | 41.0 | | 24.8 | |
| E | 4.37 | 4.40 | 4.89 | 4.93 | 3.37 | 3.36 | 3.21 | 3.22 |
| PENFORD 230 @ 1.0% | | | | | | | | |

TABLE-continued

| | | | | | | | | |
|---|---|---|---|---|---|---|---|---|
| CMC 4H1 @ .25%<br>CARBOWAX @ .5%<br>AEROSOL OT @ .2% | | 62.0 | 57.8 | 41.8 | 37.8 | 78.0 | 77.4 | 85.2 | 85.4 |
| F<br>PRYM 119 @ .75%<br>PENFORD 230 @ .75%<br>CARBOWAX @ .4%<br>AEROSOL OT @ .2% | 4.86 | 51.2 | | | | | | | |
| G<br>PENFORD 230 @ 2.0%<br>CARBOWAX @ .6%<br>AEROSOL OT @ .3% | 6.46 | 62.6 | | | | | | | |
| H<br>PENFORD 230 @ 1.2%<br>CMC 4H1 @ .3%<br>CARBOWAX @ .6%<br>AEROSOL OT @ .2% | 4.59 | 67.0 | | | | | | | |
| I<br>CARBOPOL 934 @ 1.5%<br>CARBOWAX @ .9%<br>AEROSOL OT @ .2% | 3.99 | 65.4 | | | | | | | |
| J<br>DUPONT<br>ZELCON 4200 @ 2.0%<br>CARBOWAX @ .6%<br>AEROSOL OT @ .3% | 6.64 | 32.4 | | | | | | | |
| K<br>MILEAGE 1 @ 2.0%<br>CARBOWAX @ .6%<br>AEROSOL OT @ .3% | 6.40 | 37.2 | | | | | | | |
| L<br>EASTMAN SP 100 @ 2.0%<br>CARBOWAX @ .6%<br>AEROSOL OT @ .3% | 6.48 | 34.8 | | | | | | | |
| M<br>EASTMAN 403652 @ 2.0%<br>CARBOWAX @ .6%<br>AEROSOL OT @ .3% | 6.56 | 32.6 | | | | | | | |
| N<br>CARBOPOL 934 @ 1.0%<br>PENFORD 230 @ 1.0%<br>CARBOWAX @ .9%<br>AEROSOL OT @ .7% | 5.94 | 77.0 | | | | | | | |
| O<br>CMC 4H1 @ 1.5%<br>CARBOWAX @ 1.0%<br>AEROSOL OT @ .2% | 4.34 | 97.8 | | | | | | | |

| NOTE: UPPER SQUARE DENOTES PERCENT TREATMENT LOWER SQUARE INDICATERS PERCENT GREASE RELEASED | EXAMPLE 5 | | EXAMPLE 6 | | EXAMPLE 7 | | EXAMPLE 8 | |
|---|---|---|---|---|---|---|---|---|
| | GREASE | OIL | GREASE | OIL | GREASE | OIL | GREASE | OIL |
| A<br>CONTROL<br>NO TREATMENT<br>AEROSOL OT @ .2% | 42.6 | 9.4 | | | | | 45.8 | 19.8 |
| B<br>CARBOPOL 934 @ .75%<br>CARBOWAX @ .3%<br>AEROSOL OT @ .2% | 1.68 | 1.74 | | | | | 1.84 | 1.84 |
| C<br>CMC 4H1 @ 25%<br>CARBOWAX @ .1%<br>AEROSOL OT @ .2% | 77.4 | 61.0 | | | | | 81.0 | 76.6 |
| D<br>PENFORD 230 @ 1.0%<br>CARBOWAX @ .4%<br>AEROSOL OT @ .2% | 0.62 | 0.60 | | | | | 0.62 | |
| E<br>PENFORD 230 @ 1.0%<br>CMC 4H1 @ .25%<br>CARBOWAX @ .5%<br>AEROSOL OT @ .2% | 64.6 | 39.2 | | | | | 64.6 | |
| F<br>PRYM 119 @ .75%<br>PENFORD 230 @ .75%<br>CARBOWAX @ .4%<br>AEROSOL OT @ .2% | 2.37 | | 1.92 | | | | 2.39 | |
| G | 43.2 | | 48.4 | | | | 41.0 | |
| | 3.51 | 3.51 | 2.80 | 2.94 | 2.93 | 2.98 | 3.68 | 3.62 |
| | 70.6 | 70.6 | 88.4 | 101.2 | 97.7 | 79.0 | 67.8 | 77.6 |

TABLE-continued

| | | |
|---|---|---|
| PENFORD 230 @ 2.0% | | |
| CARBOWAX @ .6% | | |
| AEROSOL OT @ .3% | | |
| H | | |
| PENFORD 230 @ 1.2% | | |
| CMC 4H1 @ .3% | | |
| CARBOWAX @ .6% | | |
| AEROSOL OT @ .2% | | |
| I | | |
| CARBOPOL 934 @ 1.5% | | |
| CARBOWAX @ 9% | | |
| AEROSOL OT @ .2% | | |
| J | | |
| DUPONT | | |
| ZELCON 4200 @ 2.0% | | |
| CARBOWAX @ .6% | | |
| AEROSOL OT @ .3% | | |
| K | 4.043 | |
| MILEAGE 1 @ 2.0% | | |
| CARBOWAX @ .6% | | |
| AEROSOL OT @ .3% | | 57.9 |
| L | 4.34 | |
| EASTMAN SP 100 @ 2.0% | | |
| CARBOWAX @ .6% | | |
| AEROSOL OT @ .3% | | 55.3 |
| M | | |
| EASTMAN 403652 @ 2.0% | | |
| CARBOWAX @ .6% | | |
| AEROSOL OT @ .3% | | |
| N | | |
| CARBOPOL 934 @ 1.0% | | |
| PENFORD 230 @ 1.0% | | |
| CARBOWAX @ .9% | | |
| AEROSOL OT @ .2% | | |
| O | | |
| CMC 4H1 @ 1.5% | | |
| CARBOWAX @ 1.0% | | |
| AEROSOL OT @ .2% | | |

Figure 6:
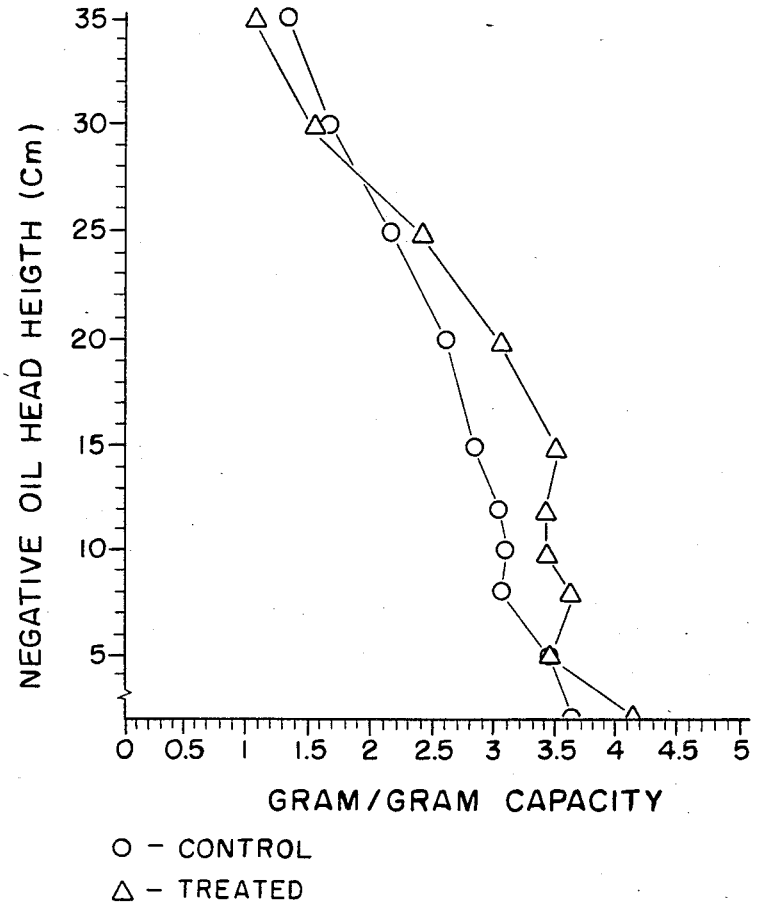
FIG. 6 illustrates capillary suction results obtained for a web of the present invention as compared to an untreated meltblown web.

From the preceding Table it can be seen that treatments in accordance with the invention are very effective in obtaining rinsing of grease and motor oil. This result is even more beneficial when considered with the results of FIG. 6 showing that capillary suction properties may be maintained. To be effective as a grease rinsing wiper, grease rinsing results of at least about 60 percent are considered essential and preferably the results are at least 80 percent. For other applications this requirement may vary.. For example, requirements for an oil spill clean up mat may not be as stringent.

Thus, it is apparent that there has been provided, in accordance with the invention, an oil and grease absorbent web having grease rinsable properties that fully satisfies the objects, aims and advantages set forth above. While the invention has been described in conjunction with the specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

We claim:

1. A treated nonwoven fabric having capillary suction properties essentially equivalent to such fabric untreated and grease rinsing properties of at least about 60 percent comprising a web of thermoplastic microfibers wherein such web contains up to about 3.5 percent by weight of a composition selected from the group consisting of:

(a) carboxymethyl cellulose and derivatives,
(b) polycarboxylic resins crosslinked with a bivalent metal ion,
(c) hydroxyethyl ether starch derivatives, and
(d) polyacrylates.

2. The fabric of claim 1 wherein said composition is carboxymethyl cellulose.

3. The fabric of claim 1 wherein said composition is a polycarboxylic resin crosslinked with a bivalent metal ion.

4. The fabric of claim 1 wherein said composition is a hydroxy ethyl ether starch derivative.

5. The fabric of claim 1 wherein said composition is a polyacrylamide resin.

6. The fabric of claims 1, 2, 3, 4, or 5 wherein said composition is a film-former and substantially coats said microfibers.

7. The fabric of claims 1, 2, 3, 4, or 5 further including up to about 75 percent by weight of an additional fibrous component.

8. The fabric of claim 7 further including a pattern of fuse bond areas covering 5 to 30 percent of the surface area and 20 to 200 bonds per square inch if individual bonds or 2 to 15 lines per inch if a line pattern.

9. The fabric of claim 8 wherein said additional fibrous component is selected from the group consisting of wood pulp, cotton and synthetic staple fibers and mixtures thereof.

10. The fabric of claims 1, 2, 3, 4 or 5 wherein said treatment composition includes up to 40 percent by weight of a softening agent.

11. The fabric of claim 10 wherein said softening agent comprises polyethylene glycol.

12. The fabric of claims 1, 2, 3, 4 or 5 wherein said fabric is bonded by an adhesive.

13. A treated nonwoven wiper having grease rinsing properties of at least 60% and comparable capillary suction properties to those of untreated wipers, said wiper comprising a web of polyolefin microfibers having a basis weight in the range of from about 50 to 120 gsm and containing as a treatment up to 3.5% by weight of a polyacrylamide resin and said wiper being bonded by a pattern of bond areas covering up to about 15% of the web surface area.

* * * * *